US005345301A

United States Patent [19]

Satoh et al.

[11] Patent Number: 5,345,301

[45] Date of Patent: Sep. 6, 1994

[54] IMAGE FIXING DEVICE AND ELECTROPHOTOGRAPHIC APPARATUS INCORPORATED WITH SUCH DEVICE

[75] Inventors: Toshiya Satoh, Hitachi; Tsuneaki Kawanishi, Naka; Ryuuichi Shimizu, Hitachiota; Akira Shimada; Katsumi Kumada, both of Hitachi, all of Japan

[73] Assignee: Hitachi, Ltd., Tokyo, Japan

[21] Appl. No.: 737,331

[22] Filed: Jul. 29, 1991

[30] Foreign Application Priority Data

Aug. 6, 1990 [JP] Japan ..... 2-208864

[51] Int. Cl.[5] ..... G03G 15/20; G03G 21/00

[52] U.S. Cl. ..... 355/290; 355/285

[58] Field of Search ..... 355/282, 285, 289, 290, 355/295

[56] References Cited

U.S. PATENT DOCUMENTS 3,874,894 4/1975 Pedersen ..... 355/295 X
4,149,797 4/1979 Imperial ..... 355/290
4,814,819 3/1989 Torino et al. ..... 355/290
4,949,132 8/1990 Chimoto ..... 355/290
4,967,237 10/1990 Sasaki et al. ..... 355/290
5,026,276 6/1991 Hirabayashi et al. ..... 355/282 X

*Primary Examiner*—Fred L. Braun
*Attorney, Agent, or Firm*—Antonelli, Terry, Stout & Kraus

[57] ABSTRACT

A electrophotographic image fixing device fixes a toner image on a substrate. The substrate is passed between two pressing rollers disposed in opposition to each other to fix toner images on the substrate. The pressing rollers includes a surface constructed from an elastic material layer such that the elastic material layer can be deformed approximately 0.5–1.5% in terms of thickness. The pressing force against the toner applied side of the substrate is adjusted to 0.3–1 kg/cm$^2$. As a result, an image with excellent toner fixing strength can be formed on a substrate such as an envelope without wrinkling the substrate during the fixing operation.

10 Claims, 4 Drawing Sheets

IMAGE FIXING DEVICE AND ELECTROPHOTOGRAPHIC APPARATUS INCORPORATED WITH SUCH DEVICE

BACKGROUND OF THE INVENTION

This invention relates to an image fixing device for fixing electrophotographic toner images on a substrate such as paper and an electrophotographic apparatus incorporated with such a fixing device.

Various methods are known for fixing a toner image formed by electrophotography on a substrate such as paper or plastic film in the electrophotographic image processing works. Typical and well known among such fixing methods is the method which makes use of heat energy. This method for fixing toner on a substrate by heat requires heating up to a temperature at which the binder resin in the toner is fused or softened to become adhesive. The toner is caused to adhere onto the substrate by the fused and adhesive binder resin. Upon cooling thereafter, the binder resin is solidified and the toner is firmly stuck on the substrate.

The most general method for effecting fusion adhesion of the toner on the substrate is to let the substrate having a toner image formed thereon be passed between a heated roll, which can be heated internally or externally, and a support roll designed to press the toner applied side of the substrate against said heated roll. Used as the heated roll in said fixing device is a roll comprising a rigid core and a fluorine resin coat formed around said core. As for support roll, there is known a roll comprising a rigid core, a layer of elastic material such as organosiloxane rubber attached to said rigid core and a fluorine resin coat on said elastic material layer (Japanese Patent Publication No. 58-43740). There is also known a support roll having a heat resistant elastic material layer and a heat resistant porous elastic body provided on said layer (Japanese Patent Publication No. H1-36624).

In said fixing device, a heated roll is contacted with the toner applied side of a substrate having a toner image formed thereon, and the toner is heated and fixed on the substrate surface while the toner is passed through a nip formed between said heated roll and a support roll.

Said fixing device is usually so constructed that the support roll is pressed by the heated roll so that a recession is formed in the support roll surface by the heated roll at the nip for securing fusion adhesion of the toner image onto the substrate. Therefore, the support roll is composed of a rigid core and a relatively thick elastic material layer formed on said core, and arrangement is made such that said recession is formed continuously always at the nip even through the support roll rotates.

In the conventional fixing devices, because of their structural arrangement designed such that a recession would be formed in the support roll by the heated roll as mentioned above, there was much risk of the substrate being wrinkled or rucked up at the end especially when the substrate was e.g., cardboard such as postcard, or envelope (i.e., a laminate composed of two or more sheets of paper which are joined at the end).

According to the studies by the present inventors, in the case of a substrate such as an envelope for instance, occurrence of said wrinkling is considered originating in the difference in movement of the nip, which is caused due to the difference in linear velocity between front paper and back paper of the envelope at the nip, which in turn is caused because, as shown in FIG. 1, there is a difference, although slight, between the distance 4 from the center of heated roll 1 to front paper 2 of the envelope and the distance 5 from said roll center to back paper 3 of the envelope. Especially when the pressing force of support roll 6 against heated roll 1 is large, as shown in FIG. 2, said support roll 6 is deflected relative to the axis of the roll, producing a difference in pressure between the end portions 9, 9' and the central portion 10 of the roll, giving rise to a difference in nip width 11 between the end 9, 9' and central 10 portions of the roll as shown in FIG. 3. It is considered that this results in producing a difference in movement between the central and end portions of the toner substrate to cause wrinkling of the substrate at its end.

SUMMARY OF THE INVENTION

An object of the present invention is to provide an image fixing device which does not cause wrinkling of the substrate during fixing of a toner image formed on the substrate by electophotography.

Another object of the present invention is to provide an electrophotographic apparatus incorporated with said fixing device.

According to the studies by the present inventors, it has been ascertained that wrinkling of the substrate during the fixing operation could be prevented by minimizing deformation of the nip formed in the support roll. Based on this finding, the present invention has been attained. The essentials of the present invention are as follows.

(1) There is provided an electrophotographic image fixing device in which a substrate having an unfixed toner image formed thereon is passed between two pressing means disposed in opposition to each other, thereby to fix the toner image on said substrate, the pressing means provided for pressing said substrate from its back side (the side opposite from the toner applied side) comprising an elastic material layer on its surface, said elastic material layer being given a pressing force that can deform said layer 0.5–1.5% in terms of thickness.

(2) The pressing means contacting the toner applied side of said substrate is provided with a heating means.

(3) There is also provided an electrophotographic apparatus comprising a photosensitive drum having a photoconductive layer forming its surface, a charging means for giving desired electric charges to the surface of said photosensitive drum, a light application means which applies light corresponding to the image information to the surface of said photosensitive drum, a developing means by which the static latent image formed on the photosensitive drum by eliminating part of the electric charges by application of light is developed with developing toner into a visible image, a transfer means for transferring said toner image onto a substrate, a fixing means for fixing the toner image transferred to said substrate, a means for removing the electric charges remaining on the surface of the photosensitive drum after said transfer, and a cleaning means for removing the toner remaining on the photosensitive drum surface after said transfer, wherein said fixing means has two pressing means disposed in opposition to each other, and the pressing means contacting the toner applied side of the substrate is provided with a heating means and its pressing force against the toner applied side of said substrate is adjusted to 0.3–1 kg/cm$^2$.

DESCRIPTION OF REFERENCE NUMERALS

Figure 1:
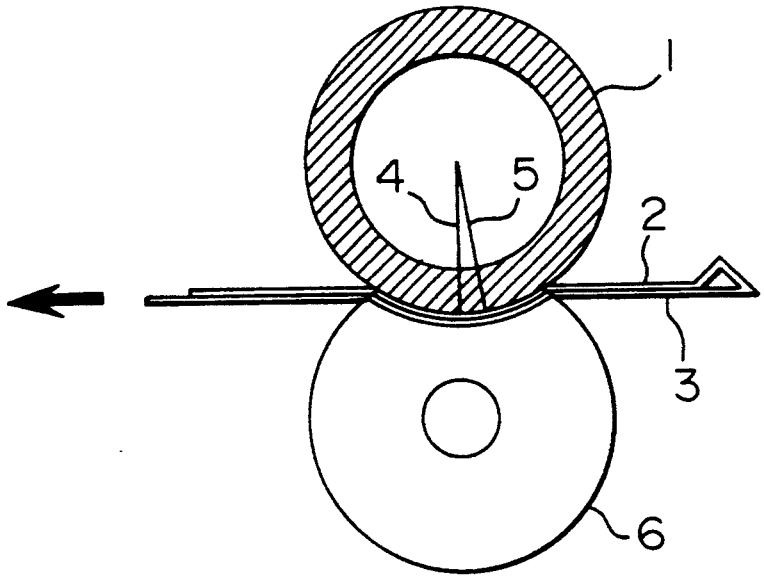
FIG. 1 is a schematic sectional view illustrating the mechanism of generation of wrinkles on a substrate of a laminate structure such as an envelope during the fixing operation.
Figure 2:
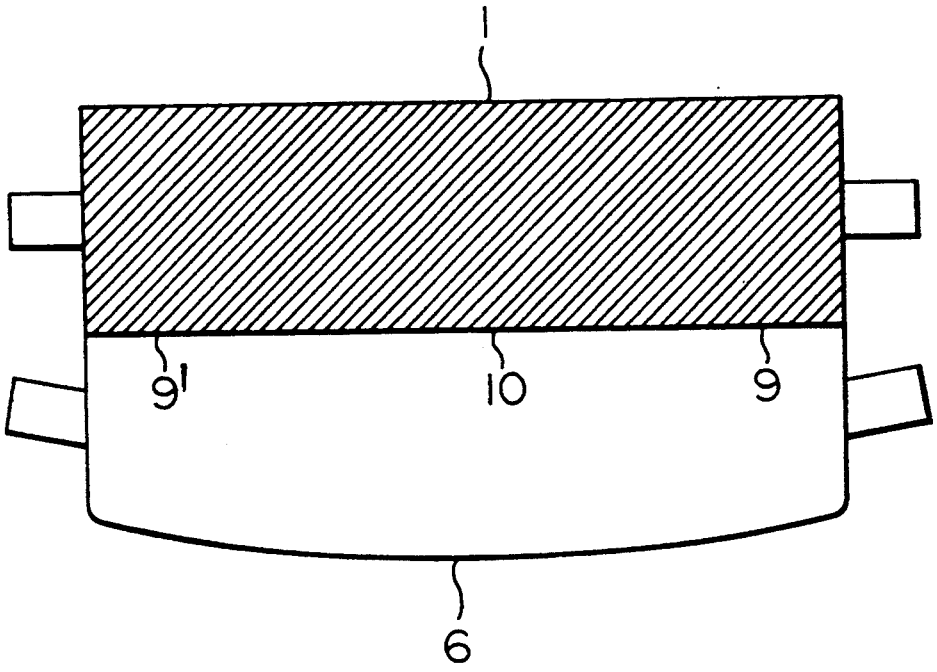
FIG. 2 is a schematic drawing illustrating the mechanism of generation of wrinkles on a substrate such as paper during the fixing operation.
Figure 3:
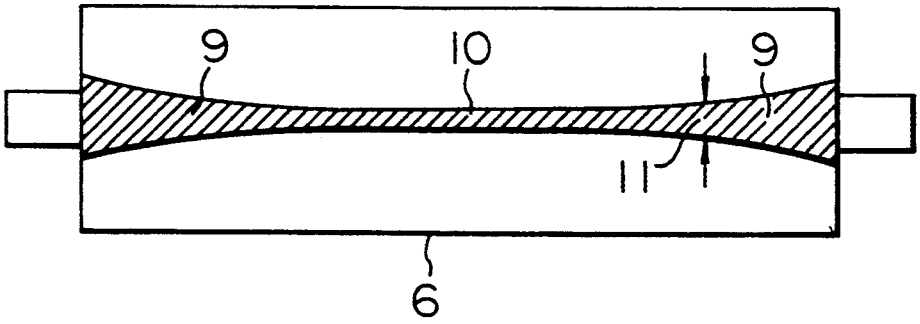
FIG. 3 is a schematic illustration of a roll in which there was produced a difference in nip width between the end portions and the central portion of the roll.

1: heated roll, 2: front paper (substrate), 3: back paper (substrate), 4: distance from the center of the heated roll to the front paper 2, 5: distance from the center of the heated roll to the back paper 3, 6: support roll, 9, 9': end portions of the roll, 10: central portion of the roll, 11: nip, 12: cylindrical core, 13: prime coat, 14: surface layer, 15: heater, 20: photosensitive drum, 21: developer, 22: toner, 23: developer unit, 24: laser light, 25: charger, 26: cleaner, 27: transferring device, 28: substrate, 29: fixing device, 31: pressing heater, 32: endless belt, 33: drive roll.

DETAILED DESCRIPTION OF THE INVENTION

In the fixing device in accordance with the present invention, it is possible to lower the pressing force of the pressing means against the toner applied side of the substrate either by reducing the pressing force between the opposing pressing means (heated roll and support roll) or by reducing the modulus of elasticity of the elastic material layer constituting a part of the support roll. The pressing force is preferably adjusted to be 1 kg/cm$^2$ or less. Otherwise the substrate tends to be wrinkled. Also, by adjusting the modulus of elasticity of the elastic material layer of the support roll to $2\times10^7$ dyn/cm$^2$ or less, it is possible to minimize the deflection in movement of the substrate at the nip of either roll, which conduces to the prevention of wrinkling of the substrate.

However, if the pressing force of said both rolls is lowered excessively, the toner fixing force will drop to an intolerable degree since the toner is not attached sufficiently solidly to the substrate even when heated to a temperature at which the binder resin of the toner is fused to become adhesive. Also, excess reduction of the modulus of elasticity of the elastic material layer of the support roll should be avoided as it lowers the pressing force against the heated roll, resulting in a reduced toner fixing force and enlarged deformation of the elastic material layer, which makes the elastic material layer liable to separate from the roll core, thus shortening the life of the rolls.

The studies by the present inventors teach that generally when the pressing force of said pressing means against the toner applied side of the substrate is less than 0.3 kg/cm$^2$, there can not be obtained a sufficient toner fixing force to the substrate, and when the modulus of elasticity of the elastic material layer of the support roll is less than $1\times10^7$ dyn/cm$^2$, the life of said roll is shortened. However, the optimum ranges of said pressing force and modulus of elasticity may vary according to the combination of toner support and roll materials and other factors.

The amount of deformation of said elastic material layer by pressing is preferably defined within the range of about 0.5 to 1.5% in terms of thickness of said layer as this makes it possible to prevent wrinkling of the substrate at the nip of the roll.

In the present invention, the pressing means on the side contacting the toner applied side of the substrate, that is, the heated roll, is preferably coated with a fluorine resin for bettering the releasability of the toner. For example, there is used a roll made by providing a 10–100 μm thick ethylene tetrafluoride resin layer around a cylindrical core made of a metal such as aluminum alloy, stainless steel, iron, copper alloy, etc., ceramics or fiber-reinforced plastics.

As the pressing means (support roll) for pressing the substrate from its back side, there is used a roll having a layer of an elastic material such as silicone rubber, fluorine rubber, fluorosilicone rubber, etc., provided relatively thickly around a cylindrical core like the heated roll.

As the heating means for said heated roll, there can be used a known heating device in which a sheathed heater and a temperature sensor adapted for controlling the temperature are disposed in a hollow portion of the cylindrical core. If necessary, heating means may be provided to both of said rolls. In case of using pressure fixed type toner, no heating means is required.

It is advisable to apply a release agent such as silicon oil on the toner contacted side of the pressing means for bettering toner releasability.

The fixing device according to the present invention is not limited to the type using the rolls; it may be of the type provided with pressing means comprising an endless belt.

In the fixing device of this invention, there is used a toner of which the absolute value G* of complex modulus at the heating temperature is in the range of $2\times10^2$ to $2\times10^3$ Pa. It is also recommended to use a toner whose dynamic viscosity $\eta$ at the heating temperature is not greater than $5\times10^3$ poises. Use of the toner with said complex modulus enables obtainment of a good fixed image free of offset. Also, use of the toner with said dynamic viscosity provides a fixed image with sufficient toner fixing force. When using a toner having both of said characteristics, there can be obtained both of said effects.

The present inventors visualized the toner fixing mechanism in case of using said fixing device as follows. The substrate having an unfixed toner image formed thereon is brought into contact with the heated roll, whereby the binder resin in the toner is changed from solid into glassy state and then into rubber-like state. In this process, when the heating temperature is relatively low and does not cause perfect fusion of the binder resin, the toner particles remain adhering to each other at the contacting sections conforming to elastic deformation of toner at that temperature. In case the adhesive force between toner and heated roll is greater than the overall adhesive force (internal cohesive force of the toner layer), there takes place cold offset. Therefore, occurrence of cold offset is governed by the sum of the contacting areas of the toner particles in the toner layer, in other words, the modulus of elasticity of toner at the particular temperature.

However, since the most part of the toner composition is binder and the binder has viscoelastic properties (adhesiveness), it is necessary to count adhesiveness of the binder at the specific temperature in the determination of the adhesive force acting to said contacting sections. The present inventors considered, therefore, that the elastic modulus of toner is related to the absolute value of complex modulus which indicates the viscoelastic properties of the toner.

When the temperature of the heated roll is higher than the binder fusing temperature, the elastic modulus of toner lowers to make the internal cohesive force of toner particles smaller than their adhesive force to the heated roll, so that no sufficient releasing force is obtained, allowing hot offset to take place. Further, tackiness of the binder at the specified temperature is counted in the adhesive force between heated roll and toner, and in this case, too, said elastic modulus of toner is related to the absolute value of complex modulus which indicates the viscoelastic properties of the toner.

According to the studies by the present inventors, it was found that by selecting and using a toner of which the absolute value G* of complex modulus is $2\times10^2$ to $2\times10^3$ Pa, it is possible to make the internal cohesive force of toner particles greater than the toner adhesive force to the heated roll and to thereby prevent occurrence of offset.

Further, the phenomenon of toner fixing can be regarded as a phenomenon of adhesion to the substrate. This phenomenon of adhesion usually follows the process of liquefaction→wetting→flowing→solidification. The toner fixing phenomenon comprises the process of sphering →sintering→deformation (spreading)→anchoring→solidification. The binder resin constituting a part of the toner also varies in state in the following course: solid→glassy state→rubber-like state→fluid. Thus, the toner fixing force is related to dynamic viscosity $\eta$ of toner when melted by heating, and the toner with excellent fixing force is the one which is capable of sharp melting and anchored to the substrate surface. The studies by the present inventors revealed that when dynamic viscosity $\eta$ of toner at the heating temperature is below $5\times10^3$ poises, there is provided sufficiently strong adhesion between toner and substrate and a good image can be obtained.

The rheological properties of the toner such as absolute value G* of complex modulus and dynamic viscosity $\eta$ were measured by a rheometer (Rheopexy Analyzer Model RPX-705 mfd. by Iwamoto Seisakusho Co., Ltd.). Measurements were conducted by setting the frequency at 0.1 Hz and the angle of distortion at 3°. The temperature characteristics were determined by using a cone and plate unit with a radius of 15 mm and a vertical angle of 87°.

The binder for toner used in the present invention may be any of those generally employed for electrophotography. However, specific consideration should be given to viscoelasticity of the binder itself in selecting the binder for use in this invention since the viscoelastic properties of the binder exerts a strong influence on the viscoelastic properties of the toner.

Examples of the binders usable in this invention are homopolymers of styrene or its substituents such as polystyrene, poly-p-chlorostyrene and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer and styrene-acrylonitrile-indene copolymer; polyvinyl chloride; polyvinyl acetate; polyethylene; polypropylene; silicone resin; polyester; polyurethane; polyamide; epoxy resin; polyvinyl butyral; rosin-modified resin; terpene resin; phenol resin; xylene resin; aliphatic or alicyclic hydrocarbon resin; aromatic petroleum resin; chlorinated paraffin; parafin wax and the like. These binders may be used either singly or in combination.

As the toner colorant, there can be used in this invention various known dyes and pigments such as carbon black, nigrosine dyes, benzidine yellow (e.g., C.I.: pigment yellow 12), nitrophenylamine sulfoneamide (e.g., C.I.: disperse yellow 33), monoazo dyes (e.g., C.I.: solvent yellow 16), quinacridones (e.g., C.I.: pigment red 122), anthraquinone dyes, diazo dyes (e.g., C.I.: solvent red 19), copper phthalocyanines (e.g., C.I.: pigment blue 15), indanthrene blue, and the like.

The toner used in the present invention is prepared into a two-component developer by mixing the toner with a known carrier, or into a single-component developer. As the carrier for preparing a two-component developer, there can be used, for example, iron powder, magnetic powder such as ferrite powder, glass beads and these materials coated with a resin on the surface.

In the image fixing device according to the present invention, it is possible to prevent wrinkling of the substrate during the fixing operation even when the substrate is of the type made of a multi-layer structure which is joined and closed at the end, such as an envelope for instance. This owes to the fact that the deflection in movement of each layer of the substrate of said multi-layer structure at the nip of the roll is reduced by minimizing deformation of the substrate during the fixing operation.

The above feature (prevention of wrinkling) of the fixing device of this invention is also associated with the reduced deflection in movement between the end portions and the central portion of the substrate, which could be attained by lessening the pressure during the fixing operation to reduce the roll deflection.

DESCRIPTION OF PREFERRED EMBODIMENTS

The present invention will be described more particularly below with reference to examples thereof.

Figure 4:
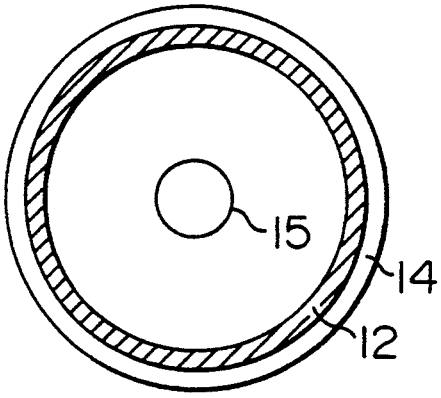
FIG. 4 is a schematic sectional view of an example of heated roll.
Figure 5:
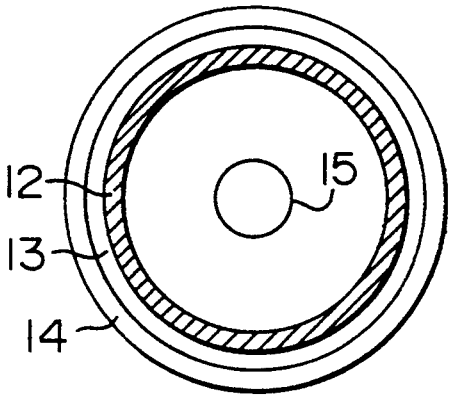
FIG. 5 is a schematic sectional view of another example of heated roll.

FIG. 4 and FIG. 5 are the schematic sectional illustrations of different examples of heated roll according to the present invention. The heated roll shown in FIG. 4 consists of a cylindrical core 12 made of an aluminum alloy and a surface resin coat 14 formed around said core 12. A heater 15 is built in the roll. The heated roll shown in FIG. 5 consists of a cylindrical core 12 made of an aluminum alloy, a primary resin coat 13 formed therearound and a surface resin coat 14 formed on said primary coat 13. A heater 15 is also built in the roll.

Figure 6:
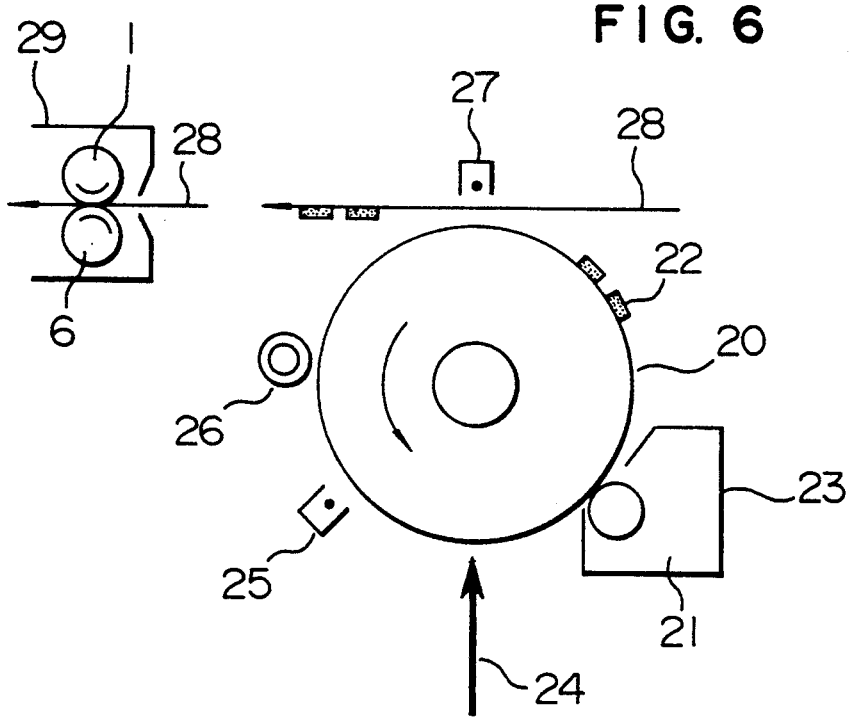
FIG. 6 is a schematic illustration of an electrophotographic apparatus.

FIG. 6 is a schematic illustration of an electrophotographic apparatus used for examining the effect of the present invention. In the apparatus is provided a photosensitive drum 20 having a surface layer of an organic photoconductive material and designed to rotate in the direction of arrow. The surface of said photosensitive drum 20 is given the specified electric charges by an electric charger 25. In this state, laser light 24 controlled according to the image information is applied to the surface of said photosensitive drum 20. The electric charges on the organic photoconductive layer at the light-applied section are eliminated and a static latent image is formed on the surface of the photosensitive drum 20. Then this static latent image on the drum surface is developed into a visible image with the toner 22 triboelectrified in the developer 21 contained in a developing device 23. This visible image is transferred to a substrate 28 by a transferring device 27 and heat fixed by a fixing device 29.

The support roll 6 of the fixing device 29 was constituted by coating the surface of the aluminum alloy-made cylindrical core with HTV (high temperature vulcanization) silicone rubber to a thickness of 13 mm to form an elastic material layer. The outer diameter of said support roll is 40 mm, and the modulus of elasticity L of the elastic material layer is $1.6\times10^7$ dyn/cm$^2$. This support roll is arranged rotatable in the direction of arrow in accordance with rotation of the heated roll 1. Said heated roll 1 and support roll 6 are each provided with a pressing means (not shown) for giving a prescribed pressing force to the roll.

EXAMPLE 1

In the heating station was used a heated roll made by coating the surface of an aluminum alloy-made cylindrical core with a PFA (tetrafluoroethylene perfluoroalkyl ether copolymer) resin to a thickness of 30 μm. On the other hand, a toner was prepared in the following way.

A blend of 100 parts by weight of a partially cross-linked polyester resin ($\overline{Mw}$=26,000; $\overline{Mw}/\overline{Mn}$=8.9) and 10 parts by weight of carbon black was heated and mixed by a roll mill, and after allowed to cool by itself, the mixture was crushed by a cutting mill, further pulverized by an ultrasonic jet mill and then classified by a zigzag classifier to obtained a toner having an average particle size of 11 μm. This toner and ferrite carrier (F-150 mfd. by Powder-Tech Corp.) were mixed in a ratio by weight of toner to carrier of 3:97 to prepare a two-component developer.

By using said developer, printing was carried out on the sheets of A4 size (210 mm×297 mm) paper of 55 kg/ream weight (about 60 g/m$^2$) and on the envelopes made of said paper, by using a laser beam printer of reversal development system at a speed of 125 mm/sec. The surface temperature of the heated roll was adjusted to 180° C. The pressing force of the support roll in said fixing device was set at 0.1, 0.3, 0.6, 1.0, 1.2, 1.5 and 4.0 kg/cm$^2$, and the occurrence or non-occurrence of wrinkling, and the degree of wrinkling when it occurred, on said sheets of paper and envelopes at each given pressing force of the support roll were examined. The toner fixing force under each said pressing force was also determined.

The toner fixing strength was determined by a tape peel test. In the test, an adhesive tape (Scotch mending tape #810 mfd. by 3M Inc.) was stuck to the surface of the fixed image whose reflection density Do had been measured, and after left as it was for a predetermined period of time, the tape was peeled off, measuring the reflection density D of the remaining image. 100 D/Do (%) was calculated and given as the toner fixing strength. Reflection density was measured by a color reflection densitometer DM-400 (mfd. by Dai-Nippon Screen Co., Ltd.). The adhesive tape was stuck on the fixed image surface by pressing the tape with a SUS roll of 85 mm in diameter and 45 mm in thickness (weighting 2 kg) at the specified pressing forces, and after leaving the test piece in an atmosphere of 23° C. for 40 minutes, said adhesive tape was peeled off at a peel angle of 180° and a peel rate of about 10 mm/sec. The results are shown in Table 1.

As seen from Table 1, both envelopes and paper sheets were free of wrinkles and also the toner fixing strength was 80% or above when the pressing force of the roll was 0.3–1.0 kg/cm$^2$.

EXAMPLE 2

The experiment of Example 1 was conducted by using the same fixing device and toner as employed in Example 1. However, the fixing speed was set at 125 mm/sec while the rate of thicknesswise deformation of the elastic material layer of the support roll at the nip thereof was set manifoldly at 0.1%, 0.4%, 0.5%, 0.8%, 1.0%, 1.5%, 1.6% and 2.0%. Wrinkling of the envelopes and paper sheets was checked and the toner fixing force was determined for each run of test. The results are shown in Table 2.

As seen from Table 2, both envelopes and paper sheets were free of wrinkles and also the toner fixing strength was 80% or above when deformation of the elastic material layer of the support roll was 0.5–1.5%.

EXAMPLES 3–9

By using the same fixing device as employed in Example 1 but by setting the fixing speed at 125 mm/sec, the pressing force of support roll at 1.0 kg/cm$^2$ and the rate of deformation of the elastic material layer of the support roll at 1.3%, the toners using the binder resins specified in Table 3 were fixed on the envelopes and paper sheets and occurrence or non-occurrence of offset of toner was examined.

The binder resins of the toners used in the respective Examples, weight average molecular weight ($\overline{Mw}$) of these binder resins, their dispersion rate ($\overline{Mw}/\overline{Mn}$), the temperature T (G*c) at which toner shows the absolute value G* of complex modulus of $2\times10^3$ Pa and the temperature T (G*h) at which toner shows G* of $2\times10^2$ Pa are shown in Table 3. Insusceptibility to offset of toner is indicated by the offset-free temperature range.

As seen from Table 3, the lower limit and upper limit of offset-free temperature range substantially agree with T (G*c) and T (G*h), respectively, in Examples 3–9, and they are decided by the absolute value G* of complex modulus. Thus, by defining the range of absolute value G* of complex modulus to $2\times10^2$ - $2\times10^3$ Pa, there can be obtained an offset-free high-quality fixed image with the fixing device of this invention. The substrate was also free of wrinkles in each case.

EXAMPLE 10

By using the same fixing device as employed in Example 1 but by setting the pressing force of the rolls at 1.0 kg/cm$^2$, the rate of deformation of the elastic material layer of the support roll at 1.3%, the fixing speed at 125 mm/sec and the fixing temperature at 180° C., toner was fixed on the envelopes and paper sheets. In the course of this experiment, the relation between dynamic viscosity $\eta$ of toner and its fixing strength was examined, obtaining the results shown in FIG. 7.

Figure 7:
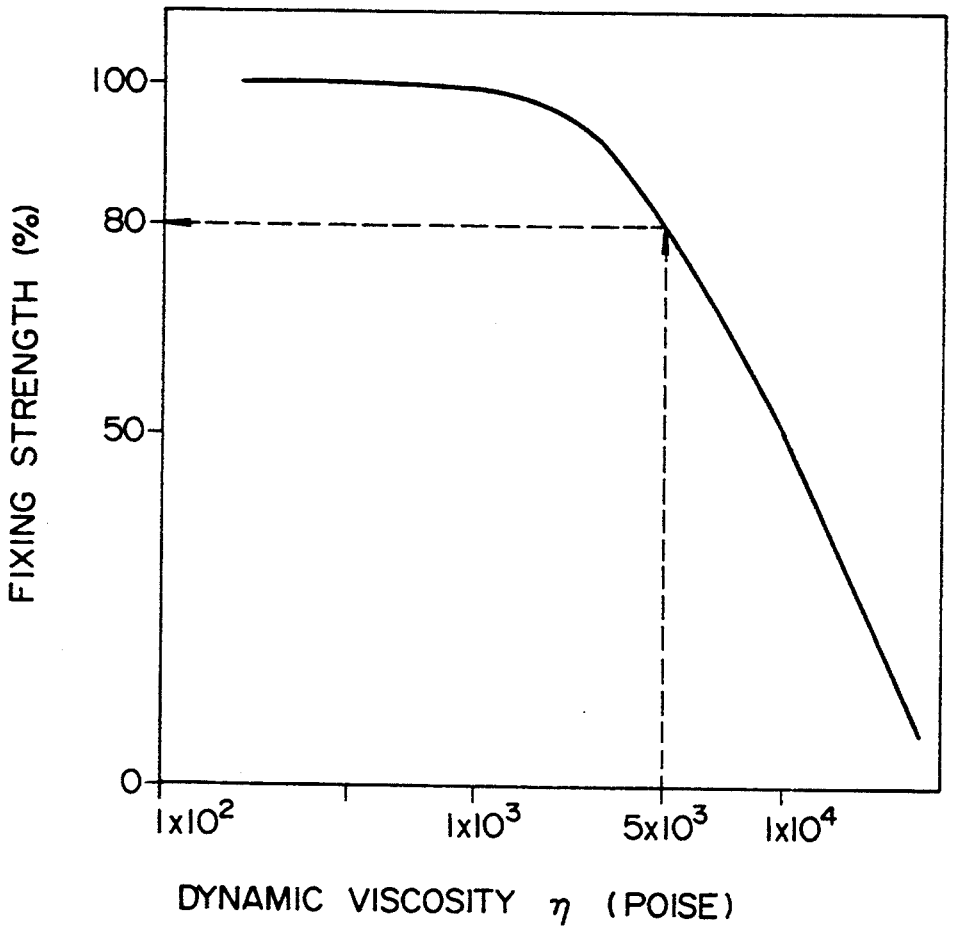
FIG. 7 is a graph showing the relation between dynamic viscosity of toner and fixing force.

As seen from FIG. 7, by using the fixing device of this invention, there can be obtained an excellent fixed image with a fixing strength above 80% when dynamic viscosity $\eta$ of toner at 180° C. is below $5\times10^3$ P.

Figure 8:
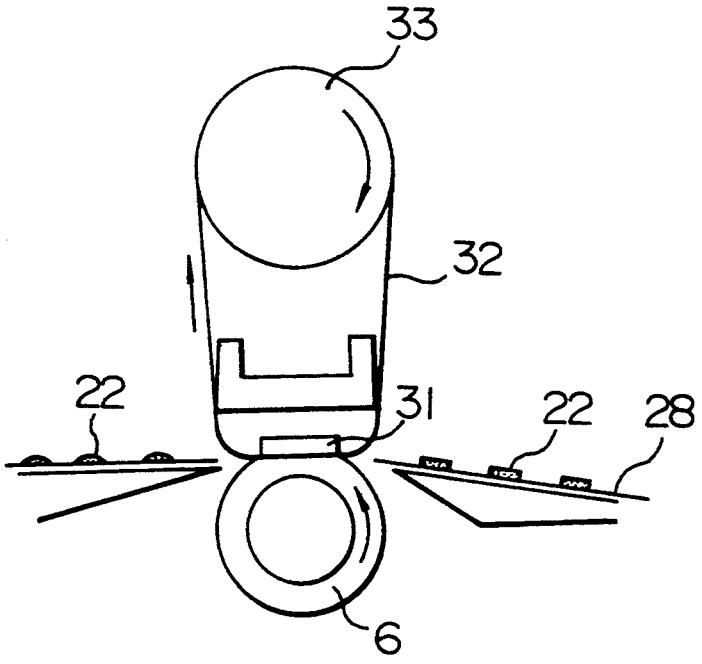
FIG. 8 is a schematic illustration of a fixing device in which the heating and pressing means are of a belt system.

In each of the Examples described above, there was employed a roll type fixing device using a heated roll and support roll combination as pressing means, but it is also possible to employ a fixing device of the type in which one of the pressing means is of an endless belt system as schematically shown in FIG. 8.

As shown in FIG. 8, a metallic endless belt 32 which is moved in the direction of arrow by a rotating drive roll 33 is contacted with and pressed against the support roll 6 by a pressure heater 31. The substrate 28 having a toner image formed thereon is passed between said endless belt 32 and support roll 6 in such a manner that the toner-applied side of the substrate 28 (toner being indicated by numeral 22) contacts the surface of said endless belt 32, and in the course of this passage, the toner image is fixed. In this operation, the pressing force at the area where the toner-applied side of the substrate 28 contacts said endless belt 32 is adjusted to 0.3–1 kg/cm$^2$ for enabling attainment of the object of the present invention.

As described above, according to the present invention, it is possible to obtain an excellent fixed image, with no fear of the substrate being wrinkled during fixing of the toner, by confining to 0.5–1.5% the rate of deformation of the elastic material layer of the support roll pressed against the heating section from the side opposite from the toner-applied side of the substrate.

In practical use of the fixing device of this invention, it is recommended to use a toner of which the absolute value G* of complex elastic modulus at the heating temperature is within the range of $2\times10^2$ to $2\times10^3$ Pa since use of such toner enables obtainment of an excellent fixed image without causing offset of toner during its fixing and wrinkling of the substrate.

Moreover, in use of said fixing device, it is possible to obtain a fixed image with excellent toner fixing strength by using a toner whose dynamic viscosity $\eta$ at the heating temperature is $5\times10^3$ P or less.

TABLE 1

| Pressing force of roll (kg/cm$^2$) | Wrinkling | Toner fixing strength (%) |
|---|---|---|
| 0.1 | ○ | 10 |
| 0.3 | ○ | 80 |
| 0.6 | ○ | 95 |
| 1.0 | ○ | 100 |
| 1.2 | Δ | 100 |
| 1.5 | Δ | 100 |
| 4.0 | x | 100 |

○: no wrinkle
Δ: partially wrinkled
x: wrinkled

TABLE 2

| Deformation of elastic material layer of roll (%) | Wrinkling | Toner fixing strength (%) |
|---|---|---|
| 0.1 | ○ | 10 |
| 0.4 | ○ | 60 |
| 0.5 | ○ | 80 |
| 0.8 | ○ | 95 |
| 1.0 | ○ | 100 |
| 1.5 | ○ | 100 |
| 1.6 | Δ | 100 |
| 2.0 | x | 100 |

○: no wrinkle
Δ: partially wrinkled
x: wrinkled

TABLE 3

| Example No. | Binder resin | $\overline{Mw}$ | $\overline{Mw}/\overline{Mn}$ | T (G*c) (°C.) | T (G*h) (°C.) | Offset-free temperature range (°C.) |
|---|---|---|---|---|---|---|
| 3 | Partially cross-linked polyester | 26,000 | 8.9 | 127 | 220 | 125–220 |
| 4 | Partially cross-linked polyester | 16,500 | 9.0 | 120 | 190 | 120–190 |
| 5 | Partially cross-linked polyester | 8,000 | 5.2 | 123 | 156 | 125–155 |
| 6 | Polyester | 93,000 | 18.5 | 144 | 201 | 145–200 |
| 7 | Styrene-acryl | 19,300 | 18.5 | 148 | 240 | 145–240 |
| 8 | Styrene-acryl | 49,000 | 9.1 | 130 | 155 | 130–155 |
| 9 | Styrene-acryl | 48,000 | 11.2 | 106 | 130 | 120–130 |

What is claimed is:

1. An electrophotographic image fixing device for fixing an unfixed toner image formed on a substrate by passing said substrate between two pressing means disposed in opposition to each other, wherein one of the pressing means which is arranged to press the substrate from a side opposite from a toner-applied side has a surface layer of an elastic material, said surface layer of elastic material being given a pressing force that causes its deformation by 0.1–1.5% in terms of thickness of said layer and wherein the pressing force between the two pressing means is adjusted to be 0.3–1 kg/cm$^2$, said deformation is not more than 1.5% in terms of thickness of said layer and the pressing force is not more than 1 kg/cm$^2$.

2. An electrophotographic image fixing device according claim 1, wherein the pressing means contacting the toner-applied side of the substrate is provided with a heating means.

3. An electrophotographic image fixing device according to claim 1, wherein at least one of the pressing means comprises a roll consisting of a cylindrical core and a resin layer formed therearound and a heating means disposed in the cylindrical core of said roll.

4. An electrophotographic image fixing device according to claim 3, wherein said resin layer is a fluorine resin layer.

5. An electrophotographic image fixing device according to claim 1, wherein the pressing means contacting the toner-applied side of the substrate comprises a fixed heating element and an endless belt arranged movable in contact with said heating element.

6. An electrophotographic image fixing device according to claim 1, wherein the elastic material layer has a modulus of elasticity of $1\times10^7$ to $2\times10^7$ dyn/cm$^2$.

7. An electrophotographic apparatus comprising:

a photosensitive drum having a photoconductive layer forming its surface, charging means for giving desired electric charges to a surface of said photosensitive drum, light application means for applying light corresponding to image information to the surface of said photosensitive drum, developing means by which a static latent image formed on the photosensitive drum surface by eliminating a portion of the electric charges by application of the light is developed with a developing toner into a toner image, transfer means for transferring said toner image onto a substrate, fixing means for fixing the toner image transferred to said substrate, means for removing the electric charges remaining on the surface of the photosensitive drum after said transfer, and cleaning means for removing the developing toner remaining on the photosensitive drum surface after said transfer, wherein said fixing means has two pressing means disposed in opposition to each other, and the pressing means contacting a toner applied side of said substrate is provided with a heating means and its pressing force against the toner applied side of the substrate is 0.3–1 kg/cm$^2$ and while the pressing means pressing the substrate from a back side opposite from the toner applied side has its surface formed from an elastic material layer, said elastic material layer being given a pressing force which causes a deformation of said layer 0.5–1.5% in terms of its thickness, said deformation is not more than 1.5% in terms of thickness of said layer and the pressing force is not more than 1 kg/cm$^2$.

8. An electrophotographic apparatus according to claim 7, wherein an absolute value G* of complex modulus of said toner at a heating temperature is $2\times10^2$ to $2\times10^3$ Pa.

9. An electrophotographic apparatus according to claim 7, wherein said toner has a dynamic viscosity $\eta$ at a heating temperature of $5\times10^3$ P or less.

10. An electrophotographic apparatus according to claim 7, wherein a main component of a binder resin in said toner is a polyester which may or may not contain a crosslinked moiety.

* * * * *